US010819052B2

(12) United States Patent
Ueda

(10) Patent No.: US 10,819,052 B2
(45) Date of Patent: Oct. 27, 2020

(54) CONNECTOR, HEADER AND CONNECTION DEVICE

(71) Applicant: PANASONIC INTELLECTUAL PROPERTY MANAGEMENT CO., LTD., Osaka (JP)

(72) Inventor: Hiroki Ueda, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/490,855

(22) PCT Filed: Feb. 27, 2018

(86) PCT No.: PCT/JP2018/007350
§ 371 (c)(1),
(2) Date: Sep. 3, 2019

(87) PCT Pub. No.: WO2018/163919
PCT Pub. Date: Sep. 13, 2018

(65) Prior Publication Data

US 2020/0006874 A1 Jan. 2, 2020

(30) Foreign Application Priority Data

Mar. 10, 2017 (JP) ..... 2017-046347

(51) Int. Cl.
*H01R 12/71* (2011.01)
*H01R 13/20* (2006.01)
*H01R 13/50* (2006.01)

(52) U.S. Cl.
CPC ..... *H01R 12/716* (2013.01); *H01R 13/20* (2013.01); *H01R 13/50* (2013.01)

(58) Field of Classification Search
CPC ..... H01R 12/716; H01R 12/712
(Continued)

(56) References Cited

U.S. PATENT DOCUMENTS 7,458,822 B2 * 12/2008 Ono ..... H01R 12/57 439/570
7,484,969 B2 * 2/2009 Shiu ..... H01R 12/716 439/660
(Continued)

FOREIGN PATENT DOCUMENTS

JP 09-266036 10/1997
JP 11-144822 5/1999
(Continued)

OTHER PUBLICATIONS

Official Communication issued in International Patent Application No. PCT/JP2018/007350, dated May 22, 2018, along with English translation.
(Continued)

*Primary Examiner* — Abdullah A Riyami
*Assistant Examiner* — Marcus E Harcum
(74) *Attorney, Agent, or Firm* — Greenblum & Bernstein, P.L.C.

(57) ABSTRACT

A connector includes a housing and a contact held by a peripheral wall of the housing. The housing has a recess that another connector is put into and the peripheral wall surrounding the recess. The contact has a pair of holders and a pair of connecting parts included in the respective holders. The pair of the holders face each other through a first space that is disposed in the recess. The pair of the connecting parts each face the first space. The other connector is designed to be electrically connected to the pair of the connecting parts.

10 Claims, 14 Drawing Sheets

(58) Field of Classification Search
USPC ..... 439/74, 66
See application file for complete search history.

(56) References Cited

U.S. PATENT DOCUMENTS

| | | | | |
|---|---|---|---|---|
| 7,553,167 | B2 * | 6/2009 | Zhang | H01R 4/2433 439/497 |
| 8,083,527 | B2 | 12/2011 | Takeuchi et al. | |
| 8,272,881 | B2 * | 9/2012 | Miyazaki | H01R 12/716 439/345 |
| 8,678,838 | B2 * | 3/2014 | Kim | H01R 13/20 439/61 |
| 8,758,029 | B2 * | 6/2014 | Midorikawa | H01R 13/2407 439/74 |
| 8,858,239 | B2 * | 10/2014 | Little | H01R 13/28 439/74 |
| 9,190,752 | B1 * | 11/2015 | Little | H01R 12/716 |
| 9,748,679 | B2 * | 8/2017 | Miyazaki | H01R 12/707 |
| 2007/0020967 | A1 * | 1/2007 | Midorikawa | H01R 12/716 439/74 |
| 2007/0105408 | A1 * | 5/2007 | Ookura | H01R 12/707 439/74 |
| 2007/0141866 | A1 * | 6/2007 | Kishi | H01R 12/716 439/74 |
| 2009/0023312 | A1 * | 1/2009 | Zeng | H01R 12/716 439/74 |
| 2009/0061655 | A1 * | 3/2009 | Miyazaki | H01R 12/57 439/74 |
| 2013/0149908 | A1 * | 6/2013 | Little | H01R 24/84 439/660 |
| 2013/0316598 | A1 * | 11/2013 | Yoshioka | H01R 12/716 439/733.1 |
| 2013/0337695 | A1 * | 12/2013 | Malehorn, II | H01R 12/57 439/658 |
| 2014/0227899 | A1 * | 8/2014 | Tanaka | H01R 13/631 439/357 |
| 2014/0377994 | A1 | 12/2014 | Miyazaki | |
| 2015/0079816 | A1 * | 3/2015 | Suzuki | H01R 12/7082 439/74 |
| 2015/0140841 | A1 * | 5/2015 | Watanabe | H01R 43/18 439/74 |
| 2016/0049744 | A1 * | 2/2016 | Miyazaki | H01R 12/73 439/626 |
| 2017/0271813 | A1 * | 9/2017 | Ge | H01R 13/504 |
| 2018/0183170 | A1 * | 6/2018 | Matsuno | H01R 13/115 |

FOREIGN PATENT DOCUMENTS

| | | |
|---|---|---|
| JP | 2012-186110 | 9/2012 |
| JP | 2015-008055 | 1/2015 |

OTHER PUBLICATIONS

The Extended European Search Report dated Feb. 7, 2020 for the related European Patent Application No. 18764774.8.

* cited by examiner

CONNECTOR, HEADER AND CONNECTION DEVICE

CROSS REFERENCE TO RELATED APPLICATION

This application is a U.S. national stage application of the PCT International Application No. PCT/JP2018/007350 filed on Feb. 27, 2018, which claims the benefit of foreign priority to Japanese patent application No. 2017-046347 filed on Mar. 10, 2017, the contents of both application are incorporated herein by reference in their entireties

TECHNICAL FIELD

The present disclosure relates to connectors, headers, and connection devices, and particularly to a connector, a header, and a connection device that are used to electrically connect electrical parts together.

BACKGROUND ART

It is known that a conventional connector is used to electrically connect electrical parts together, as is disclosed, for example, in PTL 1. A connector described in PTL 1 includes a substantially rectangular housing made from an insulator and a plurality of terminals (contacts) that is arranged in the housing and electrically connected to a circuit board.

CITATION LIST

Patent Literature

PTL 1: Unexamined Japanese Patent Publication No. 2015-8055

SUMMARY OF THE INVENTION

A connector according to an aspect of the present disclosure includes a housing and a contact held by a peripheral wall of the housing. The housing has a recess that another connector is put into and the peripheral wall surrounding the recess. The contact has a first holder, a second holder, a first connecting part included in the first holder, and a second connecting part included in the second holder. The first holder and the second holder face each other through a first space that is disposed in the recess. The first connecting part and the second connecting part each face the first space. The other connector is designed to be electrically connected to the first and the second connecting parts.

A header according to another aspect of the present disclosure is the other connector connected to the connector according to the aspect of the present disclosure described above. The header has another housing including a main body designed to be put into the recess, and a first other contact and a second other contact that are held by the main body so as to be exposed from the main body. The first contact is electrically connected to the first connecting part. The second contact is electrically connected to the second connecting part.

A connection device according to the present disclosure includes the connector according to the aspect of the present disclosure described above and another connector having a first other contact and a second other contact that are electrically connected to the contact.

DESCRIPTION OF EMBODIMENTS

It is desired that a connector, such as the conventional connector described above, has a contact that provides improved strength while being electrically connected to a contact of another connector.

In view of the challenge described above, an object of the present disclosure is to provide a connector, a header, and a connection device that have a contact capable of providing improved strength while being electrically connected to a contact of another connector.

First Exemplary Embodiment (1) Outline

With reference to FIGS. 1 to 5B, an outline of connector 101 according to a first exemplary embodiment will now be described. Connector 101 of this exemplary embodiment is attached to substrate 4 (see FIG. 10A) such as a printed wiring board or a flexible printed wiring board, for example. Connector 101 is used, for example, to electrically connect a plurality of substrates 4 together incorporated in a smartphone or other mobile terminals. This, however, should not be construed to limit a range of uses of connector 101. Connector 101 may be used, for example, in an electronic device, such as a camera module, other than mobile terminals. Connector 101 may be used to electrically connect a plurality of components together, such as substrate 4 and a display, and substrate 4 and a battery, other than electrically connecting the plurality of substrates 4 together.

Figure 6:
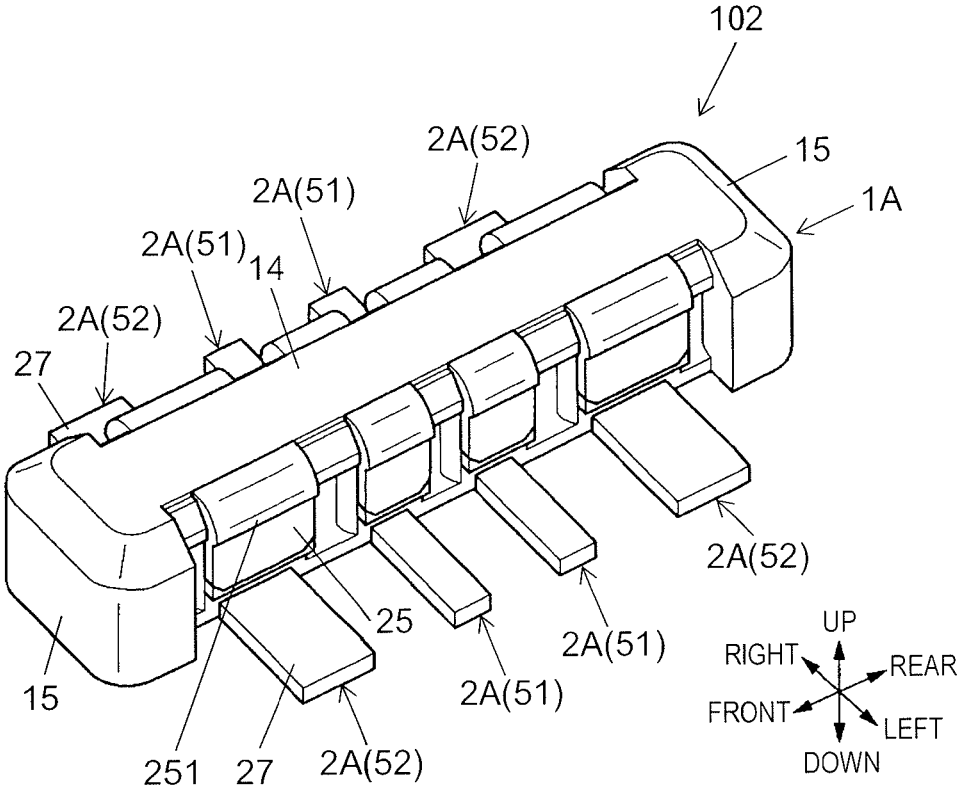
FIG. 6 is a perspective view of another connector according to the first exemplary embodiment.
Figure 7A:
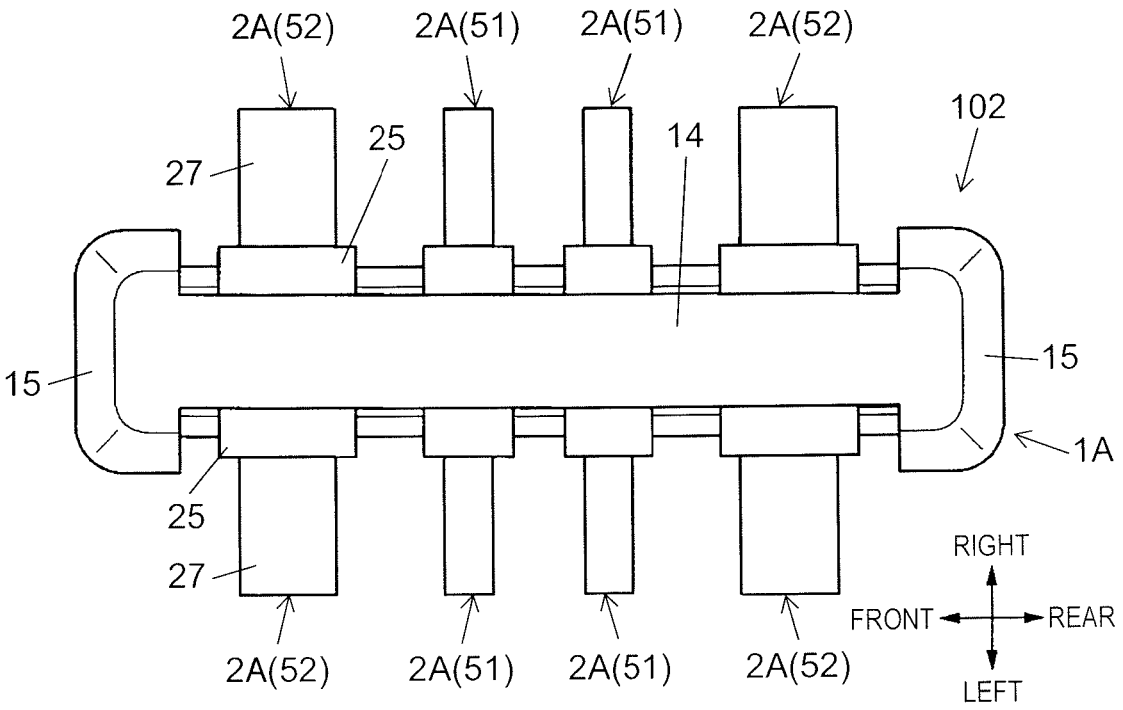
FIG. 7A is a top view of the other connector according to the first exemplary embodiment.
Figure 7B:
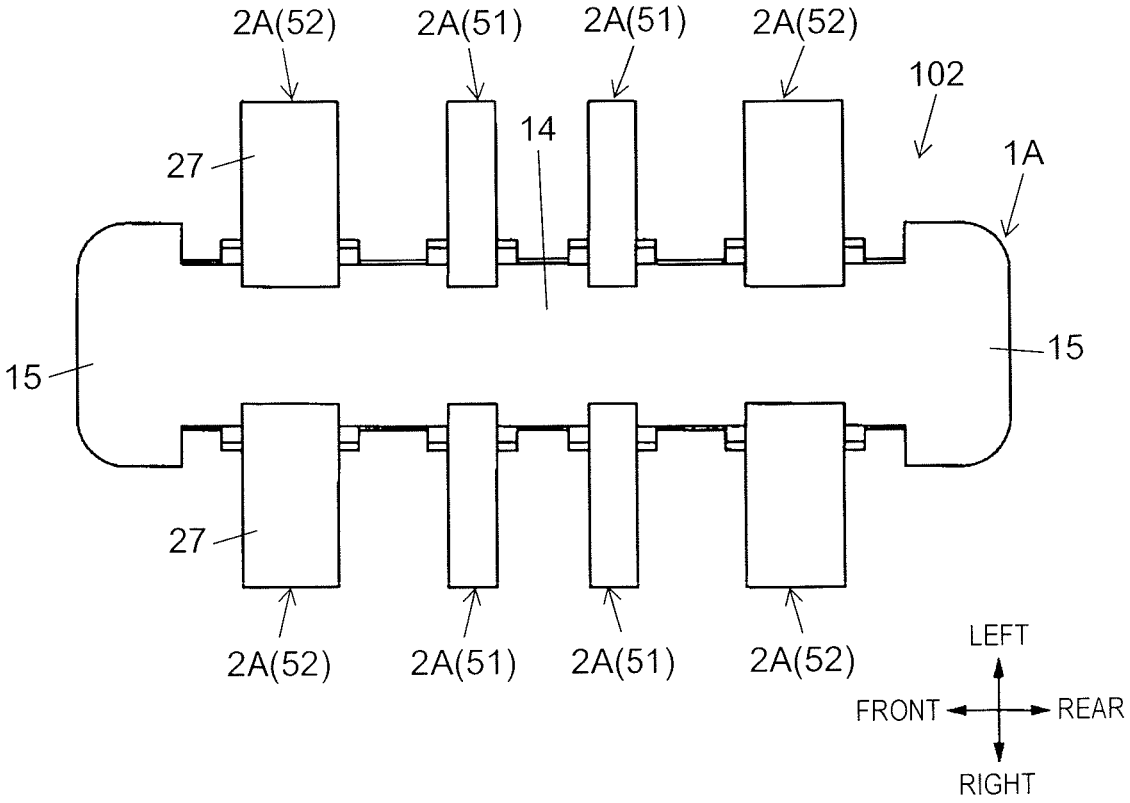
FIG. 7B is a bottom view of the other connector according to the first exemplary embodiment.
Figure 8A:
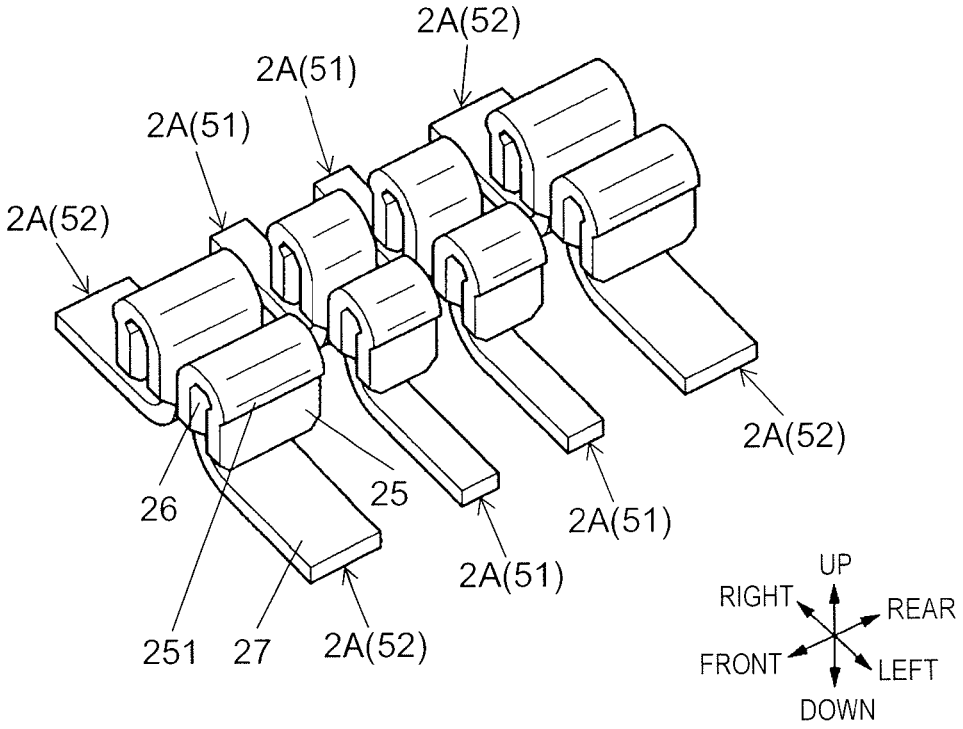
FIG. 8A is a perspective view of the other connector according to the first exemplary embodiment, omitting illustration of a housing.
Figure 8B:
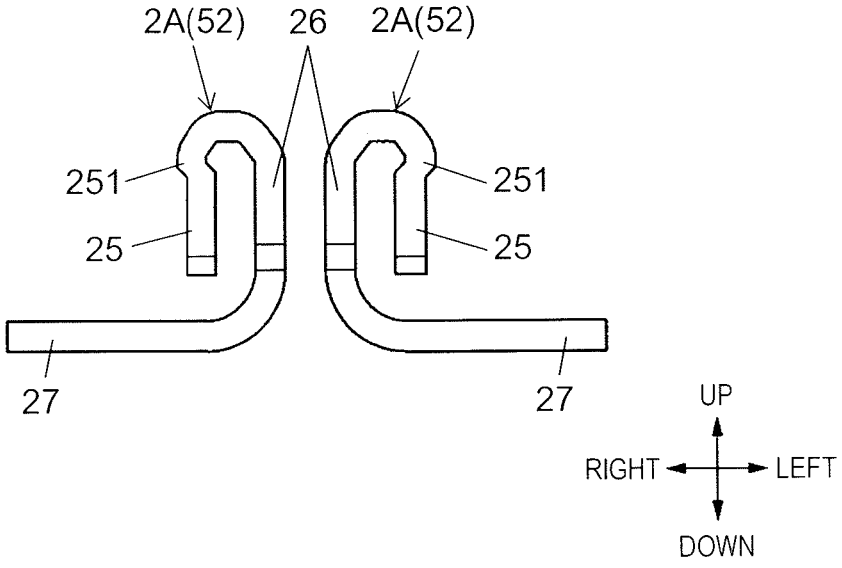
FIG. 8B is a front view of a contact in the other connector according to the first exemplary embodiment.
Figure 9:
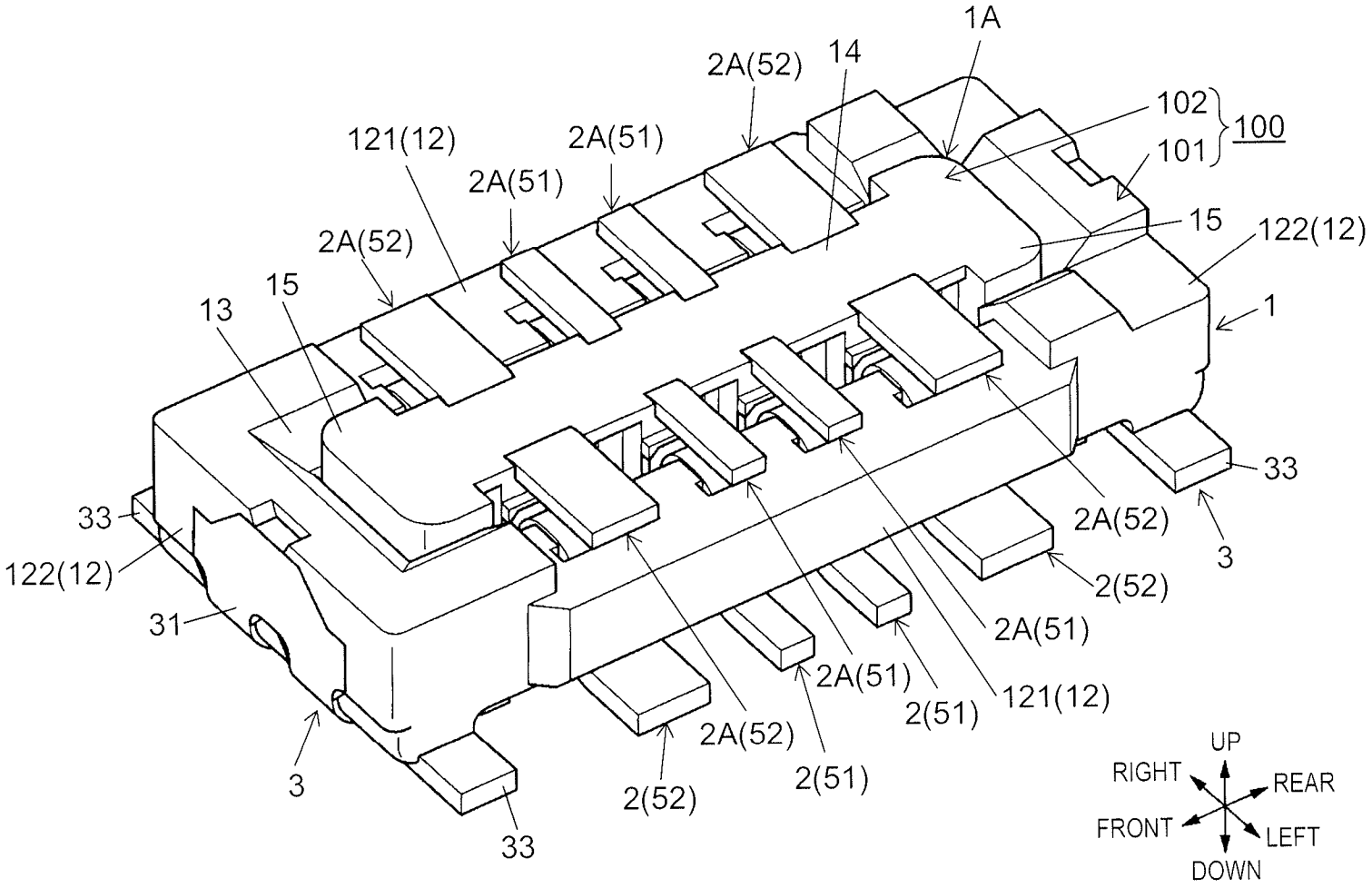
FIG. 9 is a perspective view of a connection device according to the first exemplary embodiment.

Connector 101 includes housing 1 and contact 2. In this exemplary embodiment, connector 101 has four contacts 2. Housing 1 includes recess 13 into which housing 1A of another connector (see FIG. 6; hereinafter also referred to as "housing 1A") of other connector 102 (see FIG. 6) is put and peripheral wall 12 surrounding recess 13. Contacts 2 are held by housing 1. A dimension of housing 1 in a thickness direction (an up-down direction) is, for example, less than or equal to several mm. A dimension of housing 1 in a longitudinal direction (a front-rear direction) ranges, for example, from several mm to a dozen or so mm. A dimension of housing 1 in a transverse direction (a left-right direction) is, for example, several mm.

Each contact 2 has a pair of holders 21 and a pair of connecting parts 22. In this exemplary embodiment, inner section 211 of holder 21 acts as connecting part 22. Contact 2 is held by peripheral wall 12 such that the pair of holders 21 is aligned along the transverse direction of housing 1. Gap 60 is formed between the pair of holders 21. In this configuration, gap 60 is a part of recess 13. The pair of connecting parts 22 each face gap 60 and confront each other through gap 60. The pair of connecting parts 22 are each electrically connected to contact 2A of other connector 102 (see FIG. 6; hereinafter also referred to as "contact 2A").

In connector 101 of this exemplary embodiment, the pair of connecting parts 22 put into contact with contacts 2A of other connector 102 are held by housing 1 while other connector 102 is connected to connector 101. Hence, according to this configuration, contact 2 provides improved strength while being electrically connected to contacts 2A of other connector 102.

(2) Detail

Connector 101, other connector 102, and connection device 100 according to the present exemplary embodiment will now be described in detail. In the description given hereinafter, a longitudinal direction of housings 1, 1A is referred to as a front-rear direction (a first direction), a transverse direction of housings 1, 1A is referred to as a left-right direction (a second direction), and a thickness direction of housings 1, 1A is referred to as an up-down direction (a third direction). In FIGS. 1 to 14B, arrows indicating these directions (up, down, left, right, front, and rear) viewed from a center of connector 101 (or other connector 102) are shown. These arrows are, however, illustrated to solely assist description, and they are unsubstantial. It should be noted that the definition of the directions above is not intended to limit modes of use of connector 101 or other connector 102 of this exemplary embodiment.

(2.1) Connector

First, with reference to FIGS. 1 to 5B, connector 101 according to the present exemplary embodiment will be described in detail. Connector 101 of this exemplary embodiment is a socket (a female connector) that includes housing 1, a plurality of (in this example, four) contacts 2, and a pair of metal brackets 3.

Having a flat rectangular parallelepiped shape that is long in the first direction (the front-rear direction), housing 1 is a resin molding made of a resin material (e.g., a liquid crystal polymer (LCP) resin) with insulating properties. In this exemplary embodiment, housing 1 is an insert mold including the pair of metal brackets 3 as an insert. Housing 1 has bottom wall 11 and peripheral wall 12. Bottom wall 11 is a plate-shaped part that is long in the first direction and constitutes a bottom of housing 1. Projecting upward from a peripheral edge of bottom wall 11, peripheral wall 12 is formed into a rectangular frame in a plan view. The "plan view" is hereinafter referred to as a view taken along the third direction (the up-down direction).

Specifically, peripheral wall 12 is made up of a pair of first peripheral walls 121 and a pair of second peripheral walls 122. Of peripheral wall 12, the pair of first peripheral walls 121 is a pair of walls extending along the first direction (the front-rear direction). Of peripheral wall 12, the pair of second peripheral walls 122 is a pair of walls extending along the second direction (the left-right direction). A site surrounded with the pair of first peripheral walls 121, the pair of second peripheral walls 122, and bottom wall 11 constitutes recess 13, into which housing 1A of other connector 102 is put. In other words, recess 13 is surrounded by peripheral wall 12. Housing 1A of other connector 102 is put into recess 13 and hence other connector 102 is connected to connector 101.

Housing 1 has four slits 123 that are disposed at intervals in the first direction (the front-rear direction). In the plan view, four slits 123 each have a rectangular shape that is long in the second direction (the left-right direction) and each have openings passing through the pair of first peripheral walls 121 in the third direction (the up-down direction) and an opening passing through bottom wall 11 in the third direction such that the openings are joined together. Four contacts 2 are thrust into respective four slits 123 from below and hence are held by housing 1. The "thrust into" herein is referred to as being pushed into with a certain degree or greater of force and thus conceptually includes the meaning of being pressed fit.

Housing 1 has tapered areas 124 that are formed at a peripheral edge of recess 13 on both ends in the first direction (the front-rear direction). Tapered areas 124 are inclined such that an area of an opening of recess 13 widens with an increase in level of the opening from one end (a lower end) to the other end (an upper end) in the third direction (the up-down direction). Tapered areas 124 are surfaces that guide housing 1A of other connector 102 into recess 13 in connector 101 when housing 1A is put into recess 13.

Figure 4:
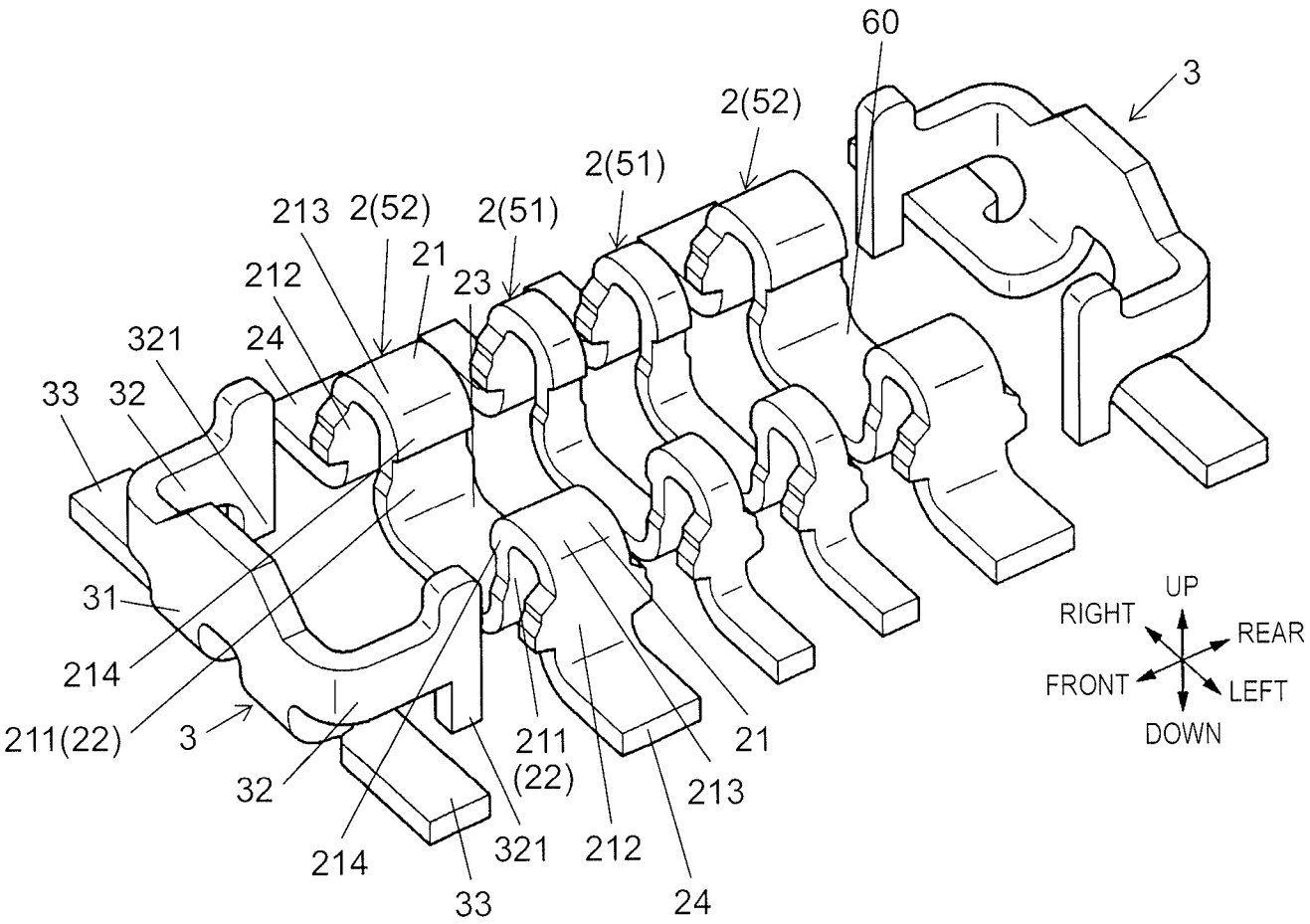
FIG. 4 is a perspective view of the connector according to the first exemplary embodiment, omitting illustration of a housing.
Figure 5A:
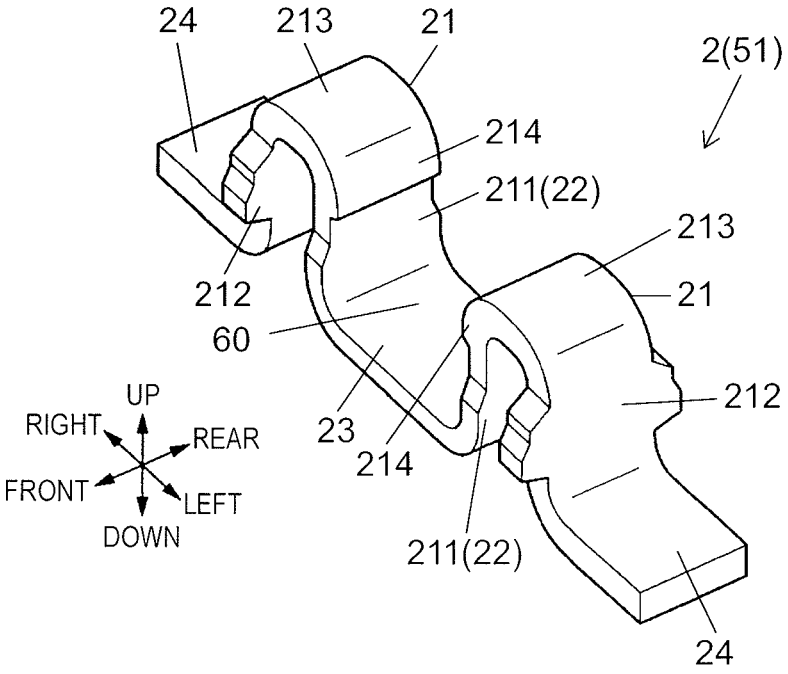
FIG. 5A is a perspective view of a contact in the connector according to the first exemplary embodiment.
Figure 5B:
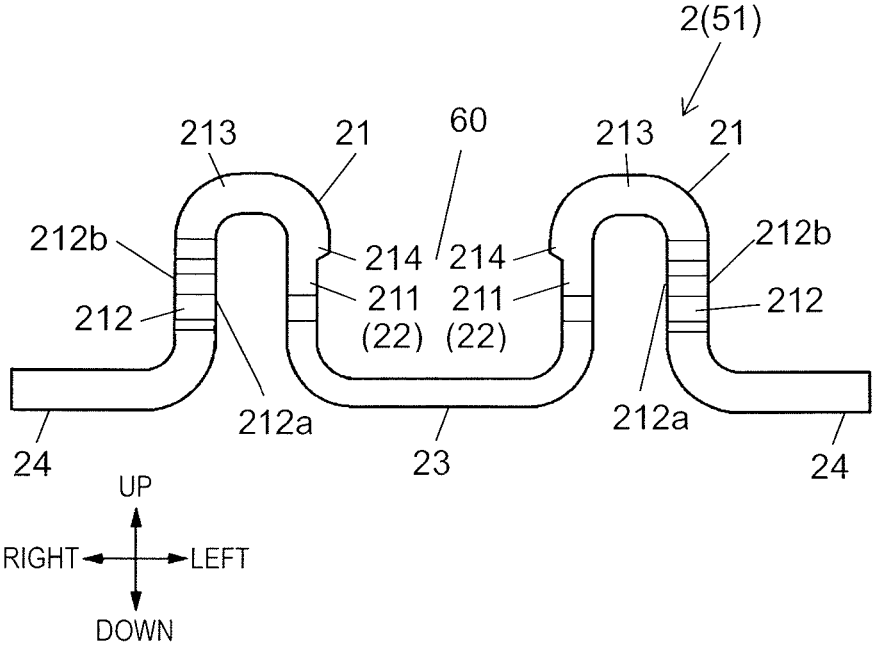
FIG. 5B is a front view of the contact in the connector according to the first exemplary embodiment.

Contact 2 is, for example, a metal molding made of a metallic material such as a copper alloy. Contact 2 is plated with gold. Contact 2 may not be plated with gold. As shown in FIGS. 4 to 5B, each contact 2 includes a pair of holders 21, bottom 23, and a pair of junctions 24 that are integrated together.

The pair of holders 21 each have inner section 211, outer section 212, and link section 213 that are integrated together. The pair of holders 21 are each formed into an inverse U shape having an apex on one end (an upper end) in the third direction in an elevation view. The "elevation view" is hereinafter referred to as a view taken along the first direction (the front-rear direction). The pair of holders 21 are held by the pair of first peripheral walls 121 such that the holders are aligned along the second direction (the left-right direction). In other words, the pair of holders 21 are disposed in recess 13 and held by peripheral wall 12 (first peripheral walls 121). In this exemplary embodiment, no obstacle (e.g., a part of housing 1) exists between the pair of holders 21 (see FIG. 1). In other words, the pair of holders 21 face each other without any obstacle interposed in recess 13. Gap 60 is formed between the pair of holders 21 of contact 2.

Figure 1:
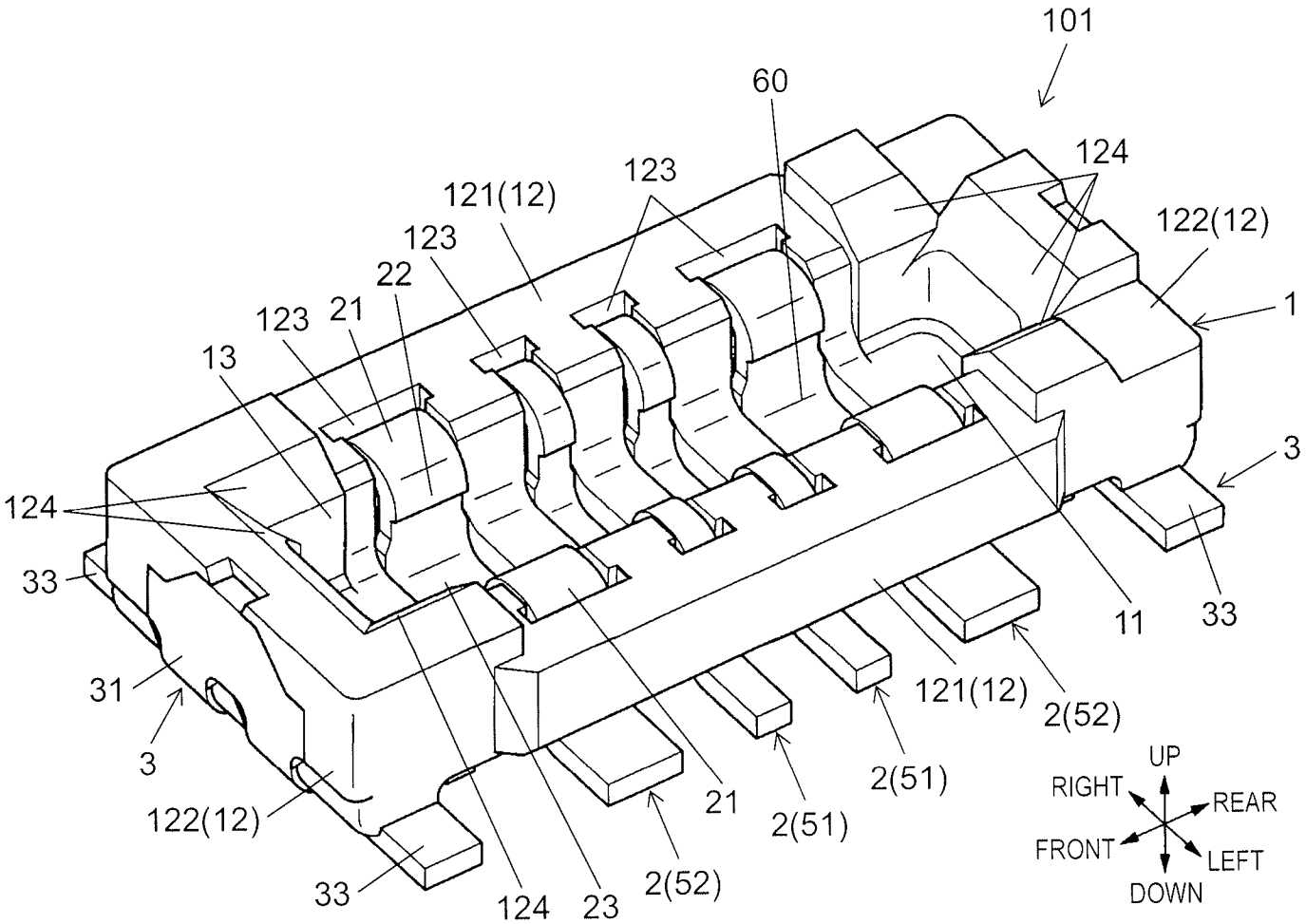
FIG. 1 is a perspective view of a connector according to a first exemplary embodiment.
Figure 2:
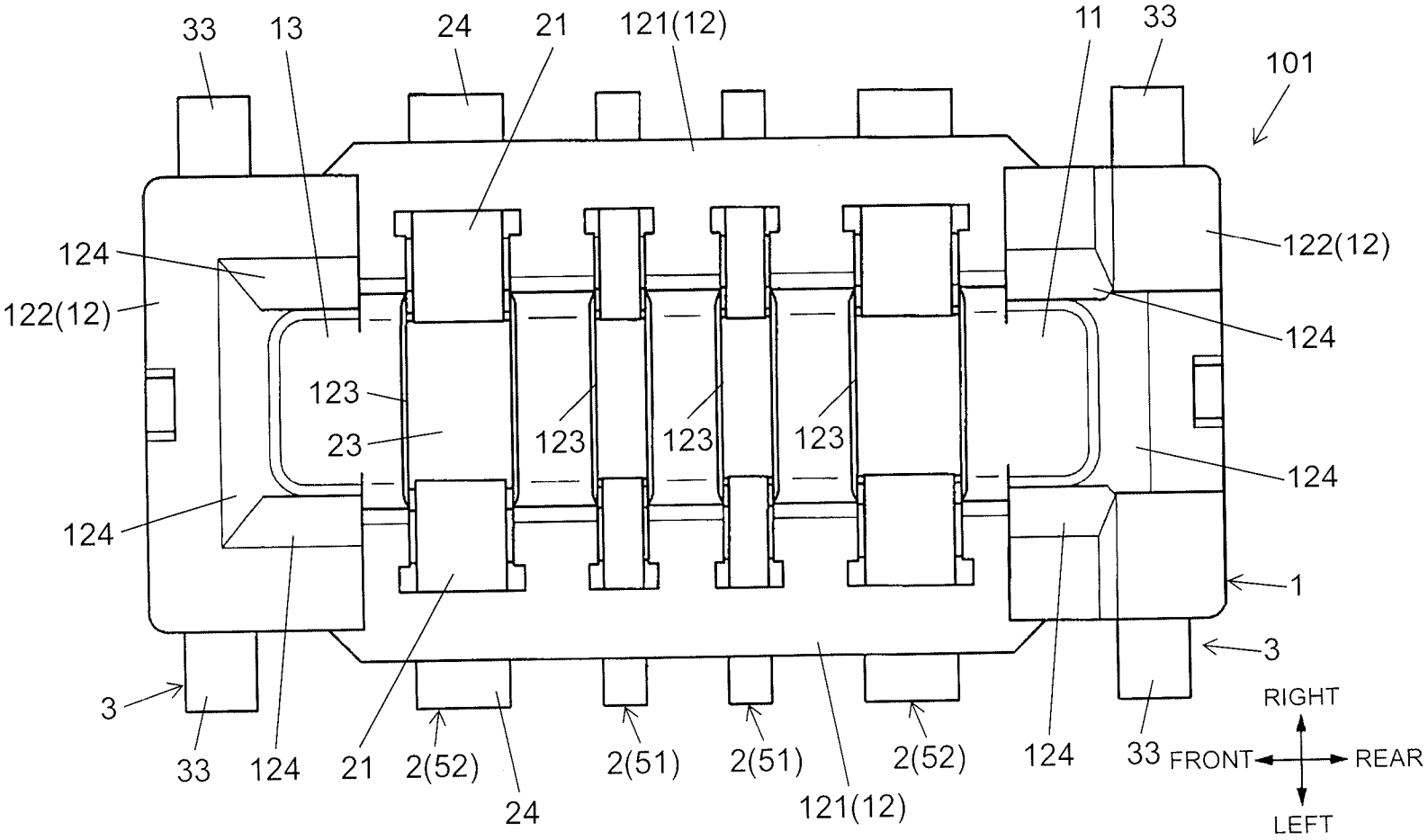
FIG. 2 is a top view of the connector according to the first exemplary embodiment.
Figure 3:
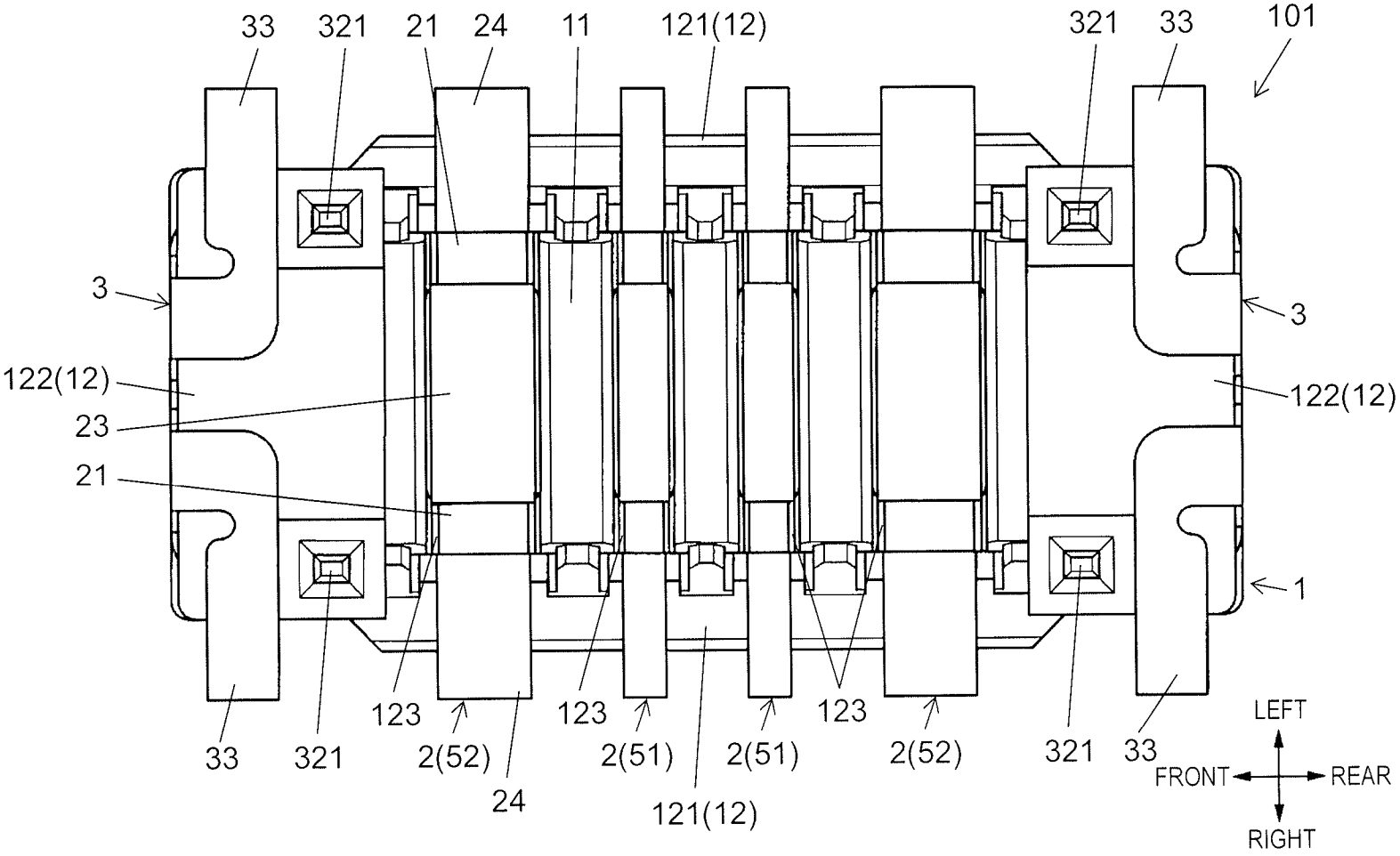
FIG. 3 is a bottom view of the connector according to the first exemplary embodiment.

Inner section 211 has a rectangular plate shape extending in the first direction (the front-rear direction) and the third direction (the up-down direction) and faces gap 60 (see FIG. 1). Inner section 211 is disposed so as to come into contact with contact 2A of other connector 102 while housing 1A of other connector 102 is put into recess 13. In this state, other connector 102 is partly put into gap 60.

Specifically, a pair of contacts 2A that are included in other connector 102 and aligned along the second direction (the left-right direction) are electrically connected to contact 2. Inner section 211 on a first side (a left side) of contact 2 in the second direction comes into contact with contact 2A on a second side (a right side) in the second direction while housing 1A is put into recess 13. Similarly, inner section 211 on a second side (a right side) of contact 2 in the second direction comes into contact with contact 2A on a first side (a left side) in the second direction while housing 1A is put into recess 13. In this exemplary embodiment, the pair of connecting parts 22 constitute inner sections 211 of the pair of respective holders 21.

Inner section 211 is integrated with projection 214 protruding along a thickness direction of inner section 211 (along the left-right direction). While housing 1A of other connector 102 is put into recess 13, projection 214 is aligned with projection 251 (described later) of corresponding contact 2A along the third direction (the up-down direction) and is located above projection 251 (see FIG. 10B). Thus, as long as a predetermined degree or greater of force is not applied to pull other connector 102 out of recess 13, connection of other connector 102 to connector 101 is not broken because of projection 251 of contact 2A getting caught on projection 214 of contact 2. In other words, projection 214 of contact 2 and projection 251 of contact 2A constitute a mechanism for locking connection between connector 101 and other connector 102 and breaking the locked connection in response to application of a predetermined degree or greater of force. To put it another way, the pair of connecting parts 22 (inner sections 211) have a mechanism (projections 214) to lock connection between contact 2 and contact 2A and break the locked connection in response to application of a predetermined degree or greater of force.

Outer section 212 has a rectangular plate shape extending in the first direction (the front-rear direction) and the third direction (the up-down direction) and faces inner section 211. Outer section 212 is located outside inner section 211 in a longitudinal direction of contact 2 (in the second direction). Outer sections 212 that are not exposed to gap 60 are held by peripheral wall 12 (first peripheral walls 121). One surface (a left surface) of outer section 212 on the first side (the left side) of contact 2 in the second direction is in contact with a part of first peripheral wall 121 on the first side in the second direction (see FIG. 10A). Similarly, one surface (a right surface) of outer section 212 on the second side (the right side) of contact 2 in the second direction is in contact with a part of first peripheral wall 121 on the second side in the second direction. In other words, of outer sections 212, surfaces 212*a* facing inner sections 211 and surfaces 212*b* opposed to surfaces 212*a* are in contact with the parts of peripheral wall 12 (first peripheral walls 121).

Link section 213 links one end (an upper end) of inner section 211 in the third direction to one end (an upper end) of outer section 212 in the third direction. In other words, link section 213 links the one ends (the upper ends) of inner and outer sections 211 and 212 remote from bottom 23. Link section 213 is formed into an inverse U shape having an apex on one end (an upper end) in the third direction in the elevation view.

Bottom 23 has a rectangular plate shape that is long in the second direction (the left-right direction). Bottom 23 is positioned between the pair of holders 21 so as to close the opening of slit 123 for bottom wall 11. A first end (a left end) of bottom 23 in a longitudinal direction is integrated with one end (a lower end) of inner section 211 on the first side (the left side) in the second direction. A second end (a right end) of bottom 23 in the longitudinal direction is integrated with one end (a lower end) of inner section 211 on the second side (the right side) in the second direction. In other words, bottom 23 located at bottom wall 11 for recess 13 links the pair of holders 21 together.

The pair of junctions 24 are disposed on both ends in the longitudinal direction of contact 2 (in the second direction). In other words, the pair of junctions 24 are located outside the pair of holders 21 in the longitudinal direction of contact 2 (in the second direction). The pair of junctions 24 stick out beyond housing 1 in the second direction (the left-right direction). The pair of junctions 24 each have one surface (a lower surface) that is a junction face joined to substrate 4 by soldering, for example. In other words, the pair of junctions 24 are disposed on both ends of contact 2 in a direction (the second direction) along which the pair of holders 21 are aligned. The pair of junctions 24 are configured to be joined to substrate 4.

In this exemplary embodiment, pairs of junctions 24 are disposed on both sides of housing 1 in the second direction (the left-right direction). In the plan view, the pairs of junctions 24 are disposed symmetric with respect to a line passing through a center of housing 1 in the second direction (see FIG. 2). Hence, in this exemplary embodiment, a phenomenon of balanced self alignment readily happens on both sides of housing 1 in the second direction when a plurality of contacts 2 is joined to substrate 4 by soldering, for example. This configuration in the present exemplary embodiment reduces the occurrence of an imbalance in self alignment on both sides of housing 1 in the second direction and thus reduces the occurrence of rotation of connector 101 relative to substrate 4 owing to a phenomenon of imbalanced self alignment.

The plurality of contacts 2 is largely classified into first terminal 51 and second terminal 52 (see FIG. 1). First terminal 51 and second terminal 52 can be each used as a terminal for signals. In this exemplary embodiment, four contacts 2 are made up of two first terminals 51 and two second terminals 52. In this exemplary embodiment, four contacts 2 are aligned along the longitudinal direction of housing 1 (the first direction) such that two first terminals 51 are disposed between two second terminals 52. Second terminal 52 is greater than first terminal 51 in width (a dimension in the first direction (the front-rear direction)). Hence, impedance of second terminal 52 is lower than that of first terminal 51. In other words, second terminal 52 has a rated current higher than the rated current of first terminal 51. As a result, second terminal 52 can be used as a terminal for a battery or other power sources, for example.

The pair of metal brackets 3 are each, for example, a metal molding made of a metallic material such as a copper alloy. The pair of metal brackets 3 are disposed on both ends of housing 1 in the longitudinal direction (the first direction). The pair of metal brackets 3 mounted on housing 1 possess a function of improving strength of housing 1. The pair of metal brackets 3 each include one main section 31, a pair of side sections 32, and a pair of bottom sections 33 that are integrated together. Of the pair of metal brackets 3, metal bracket 3 mounted on a first end (a front end) of housing 1 in the first direction is taken as an example in the following description. Metal bracket 3 mounted on a second end (a rear end) of housing 1 in the first direction has a similar configuration.

Main section 31 is mounted on second peripheral wall 122 on one end side (in this example, a front side) in the first direction. The pair of side sections 32 protrude toward an inside of housing 1 (in this example, rearward) from both ends of main section 31 in the second direction (the left-right direction). The pair of side sections 32 each include projected section 321 protruding downward. One end (a lower end) of projected section 321 in the third direction is exposed to an outside by passing through bottom wall 11 of housing 1 (see FIG. 3). One surface (a lower surface) of projected section 321 is a junction face joined to substrate 4 by soldering, for example.

The pair of bottom sections 33 are integrated with one end (a rear end) of main section 31 in the third direction and are bent so as to run along bottom wall 11 of housing 1. Bottom section 33 on the first side (the left side) in the second direction is held by housing 1 such that the bottom section and a plurality of (in this example, four) junctions 24 located on the first side (the left side) in the second direction are aligned along the first direction (the front-rear direction). Similarly, bottom section 33 on the second side (the right side) in the second direction is held by housing 1 such that the bottom section and a plurality of (in this example, four) junctions 24 located on the second side (the right side) in the second direction are aligned along the first direction (the front-rear direction). The pair of bottom sections 33 each have one surface (a lower surface) that sticks out beyond bottom wall 11 of housing 1 and that is a junction face joined to substrate 4 by soldering, for example.

(2.2) Other Connector

With reference to FIGS. 6 to 8B, other connector 102 corresponding to connector 101 according to the present exemplary embodiment will now be described in detail. Other connector 102 of this exemplary embodiment is a header (a male connector) that includes housing 1A and a plurality of (in this example, eight) contacts 2A. In this exemplary embodiment, a pair of contacts 2A aligned along the second direction (the left-right direction) make up one contact group. A plurality of (in this example, four) contact groups is aligned along the first direction (the front-rear direction) and is held by housing 1A. The plurality of the contact groups corresponds one to one to the plurality of contacts 2 of connector 101.

Housing 1A is a resin molding with insulating properties. In this exemplary embodiment, housing 1A is an insert mold including the plurality of contacts 2A as an insert. Housing 1A has main body 14 and a pair of flanges 15.

Main body 14 has a flat rectangular parallelepiped shape that, is long in the first direction (the front-rear direction). Main body 14 has dimensions such that the main body combined with the pair of flanges 15 are put into recess 13 in connector 101. The plurality of contacts 2A partly sticks out from both ends of main body 14 in the second direction (the left-right direction). In this exemplary embodiment, four contact 2A are aligned along the first direction and held on a first end (a left side) of main body 14 in the second direction, with each contact 2A including contact section 25 (described later) and terminal section 27 (described later) exposed to the outside. Similarly, four contact 2A are aligned along the first direction and held on a second end (a right side) of main body 14 in the second direction, with each contact 2A including contact section 25 and terminal section 27 exposed to the outside. In this example, the pair of contacts 2A aligned along the second direction are apart from each other in the second direction and are held by solid main body 14. In other words, the space between the pair of contacts 2A is occupied by housing 1A.

The contact groups are electrically connected one to one to the pairs of connecting parts 22 of contacts 2 while housing 1A is put into recess 13 of connector 101. Thus, in this exemplary embodiment, the pair of contacts 2A aligned along the second direction (the left-right direction) are electrically connected to the corresponding contacts at an identical potential. In other words, other connector 102 has at least one (in this exemplary embodiment, four) pair of contacts 2A that are held by housing 1A so as to be each exposed partly to outside main body 14 and that are electrically connected one to one to the pair of connecting parts 22.

The pair of flanges 15 protrude from both ends of main body 14 in the first direction (the front-rear direction). A dimension of the pair of flanges 15 in the second direction (the left-right direction) is larger than a dimension of main body 14 in the second direction. Specifically, the pair of flanges 15 each have a dimension in the second direction such that contact sections 25 of the plurality of contacts 2A protruding from main body 14 are hidden in the elevation view. In other words, other connector 102 further includes the pair of flanges 15 protruding from both ends of main body 14 in a direction (the first direction) intersecting with a direction (the second direction) along which the pairs of contacts 2A are each aligned. The pair of flanges 15 protrude beyond areas (contact sections 25) of the pairs of contacts 2A that come into contact with the pairs of connecting parts 22 in the direction (the second direction) along which the pairs of contacts 2A are each aligned.

Contact 2A is, for example, a metal molding made of a metallic material such as a copper alloy. Contact 2A is plated with gold. Contact 2A may not be plated with gold. Each contact 2A includes contact section 25, pendent section 26, and terminal section 27 that are integrated together (see FIGS. 8A and 8B). Contact section 25 is shaped like a rectangular plate. Contact section 25 is disposed so as to stick out from a surface of main body 14 in the second direction (the left-right direction). Contact section 25 is configured to come into contact with corresponding connecting part 22 while housing 1A is put into recess 13 in connector 101.

Contact section 25 is integrated with projection 251 protruding along a thickness direction of contact section 25 (along the left-right direction). While housing 1A is put into recess 13 in connector 101, projection 251 is aligned with projection 214 of corresponding contact 2 along the third direction (the up-down direction) and is located below projection 214 (see FIG. 10B). As already described, projection 251 together with projection 214 of contact 2 constitute a mechanism for locking connection between connector 101 and connector 102 and breaking the locked connection in response to application of a predetermined degree or greater of force.

Pendent section 26 has a rectangular plate shape that is long in the third direction (the up-down direction). Pendent section 26 is opposed to contact section 25 in the second direction (the left-right direction). A first end (an upper end) of pendent section 26 in the third direction is bent into an inverse U shape and is integrated with a first end (an upper end) of contact section 25 in the third direction.

Terminal section 27 has a rectangular plate shape that is long in the second direction (the left-right direction). A first end of terminal section 27 in the second direction is integrated with a second end (a lower end) of pendent section 26 in the third direction. A second end of terminal section 27 in the second direction sticks out from housing 1A. One surface (a lower surface) of terminal section 27 in the third direction is a junction face joined to substrate 4 by soldering, for example.

In this exemplary embodiment, pairs of terminal sections 27 are disposed on both sides of housing 1A in the second direction (the left-right direction). In the plan view, the pairs of terminal sections 27 are disposed symmetric with respect to a line passing through a center of housing 1A in the second direction (see FIG. 7A). Hence, in this exemplary embodiment, a phenomenon of balanced self alignment readily happens on both sides of housing 1A in the second direction when a plurality of contacts 2A is joined to substrate 4 by soldering, for example. This configuration in the present exemplary embodiment reduces the occurrence of an imbalance in self alignment on both sides of housing 1A in the second direction and thus reduces the occurrence of rotation of other connector 102 relative to substrate 4 owing to a phenomenon of imbalanced self alignment.

In a similar way to contacts 2, the plurality of contacts 2A is largely classified into first terminal 51 and second terminal 52. In this exemplary embodiment, eight contacts 2A are made up of four first terminals 51 and four second terminals 52. In this exemplary embodiment, four contacts 2A on either side of main body 14 in the second direction (the left-right direction) are aligned along the longitudinal direction of housing 1A (the first direction). On either side of main body 14 in the second direction, two first terminals 51 are disposed between two second terminals 52. In this exemplary embodiment, other connector 102 has no metal brackets 3. Instead, four contacts 2A equivalent to second terminals 52 function as metal brackets.

Concerning both contacts 2, 2A in this exemplary embodiment, a cross-sectional shape of first terminals 51 is identical to a cross-sectional shape of second terminals 52 when viewed along the first direction (the front-rear direction). The "identical" used herein includes a meaning of "substantially identical". Accordingly, a slight difference in cross-sectional shape between first and second terminals 51 and 52 due to manufacturing errors or variations falls within a permissible tolerance.

(2.3) Connection Device

Connector 101 is, for example, mounted on substrate 4 (hereinafter also referred to as "first substrate 41") built in an electronic device such as a smartphone (see FIG. 10A). Similarly, other connector 102 corresponding to connector 101 is mounted on other substrate 4 (hereinafter also referred to as "second substrate 42") built in an electronic device (see FIG. 10A).

Figure 10A:
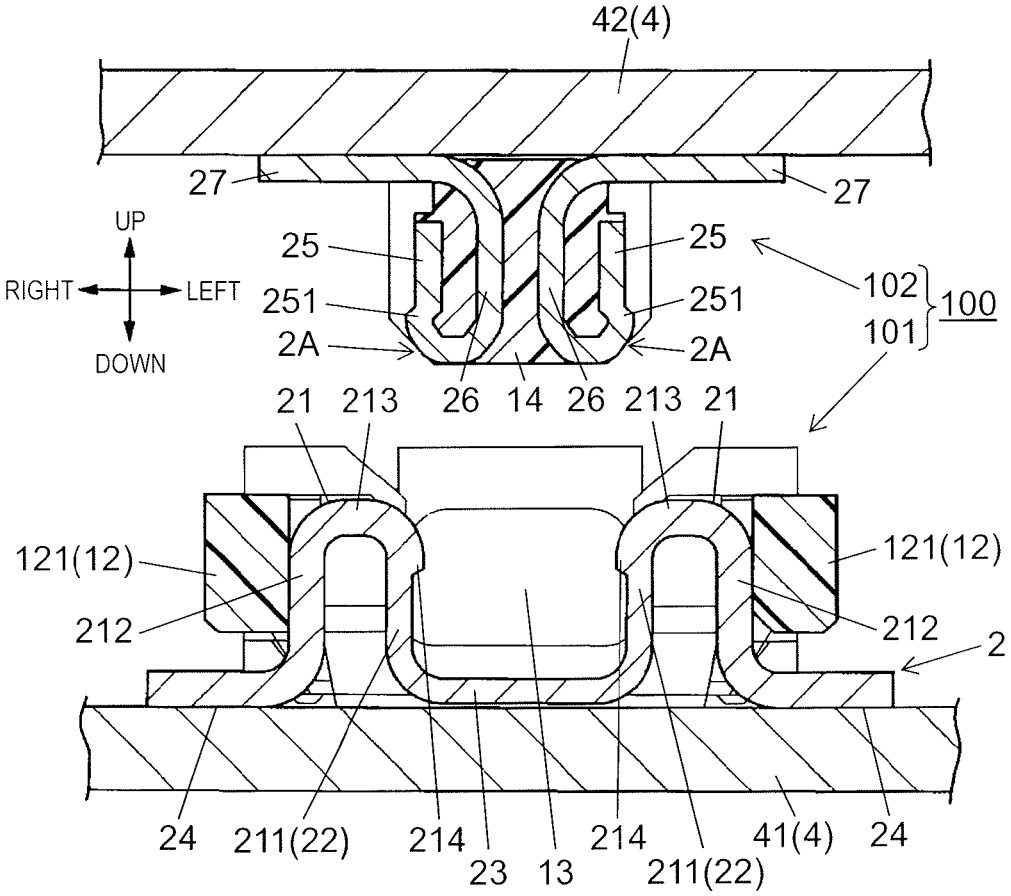
FIG. 10A is a cross-sectional view of the connection device according to the first exemplary embodiment in a state before the other connector is connected to the connector.
Figure 10B:
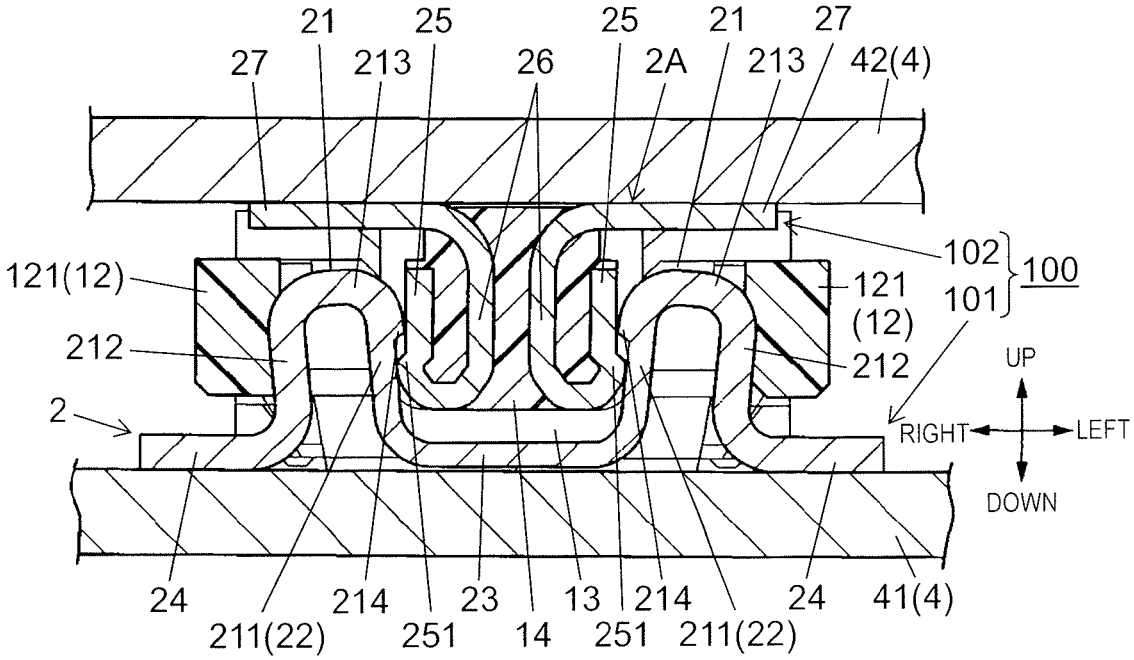
FIG. 10B is a cross-sectional view of the connection device according to the first exemplary embodiment in a state after the other connector is connected to the connector.
Figure 11:
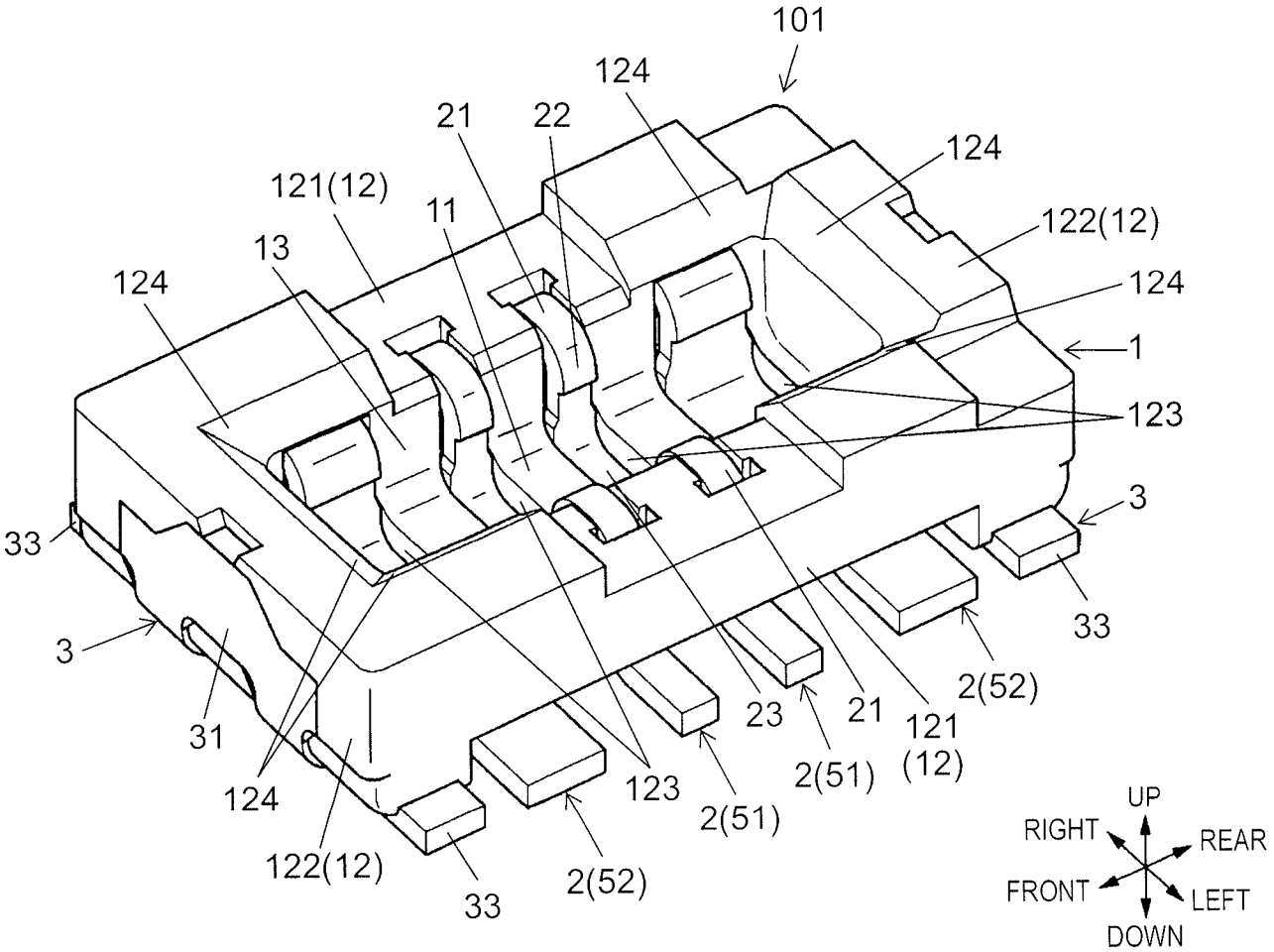
FIG. 11 is a perspective view of a connector according to a second exemplary embodiment.
Figure 12A:
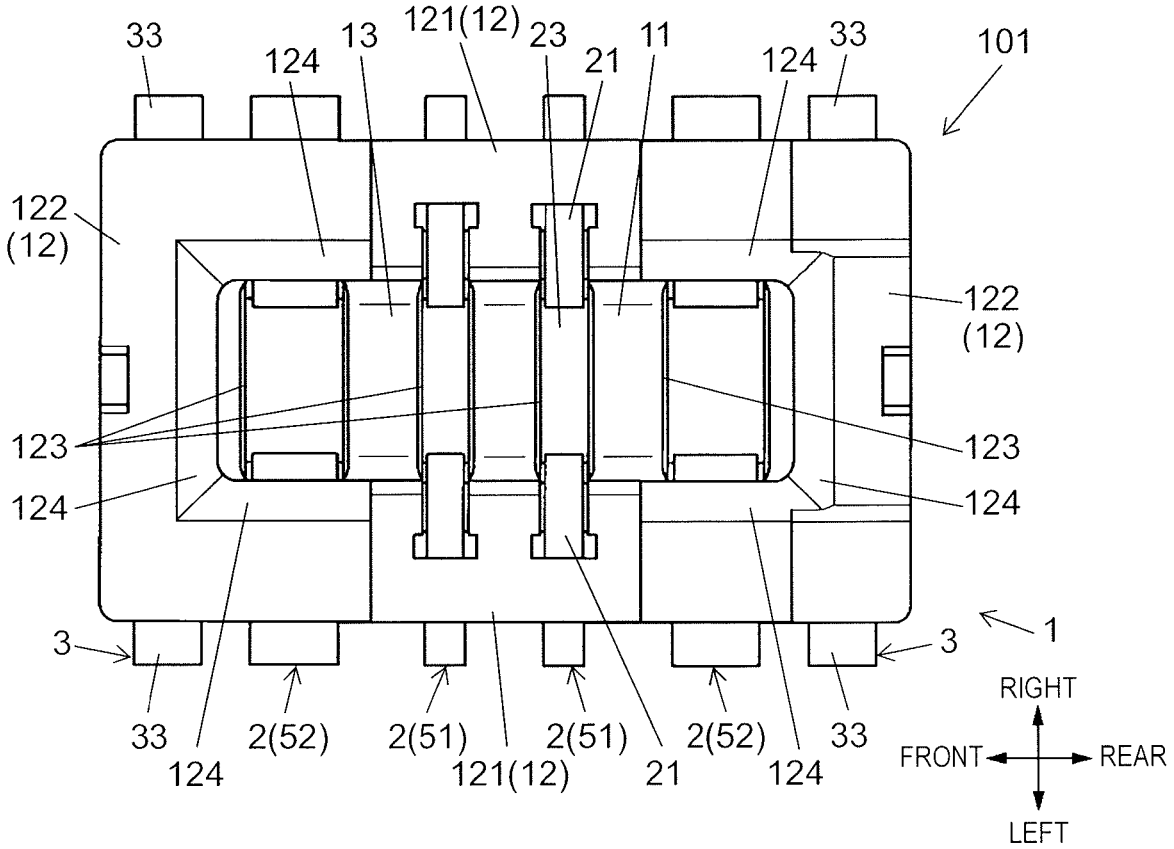
FIG. 12A is a top view of the connector according to the second exemplary embodiment.
Figure 12B:
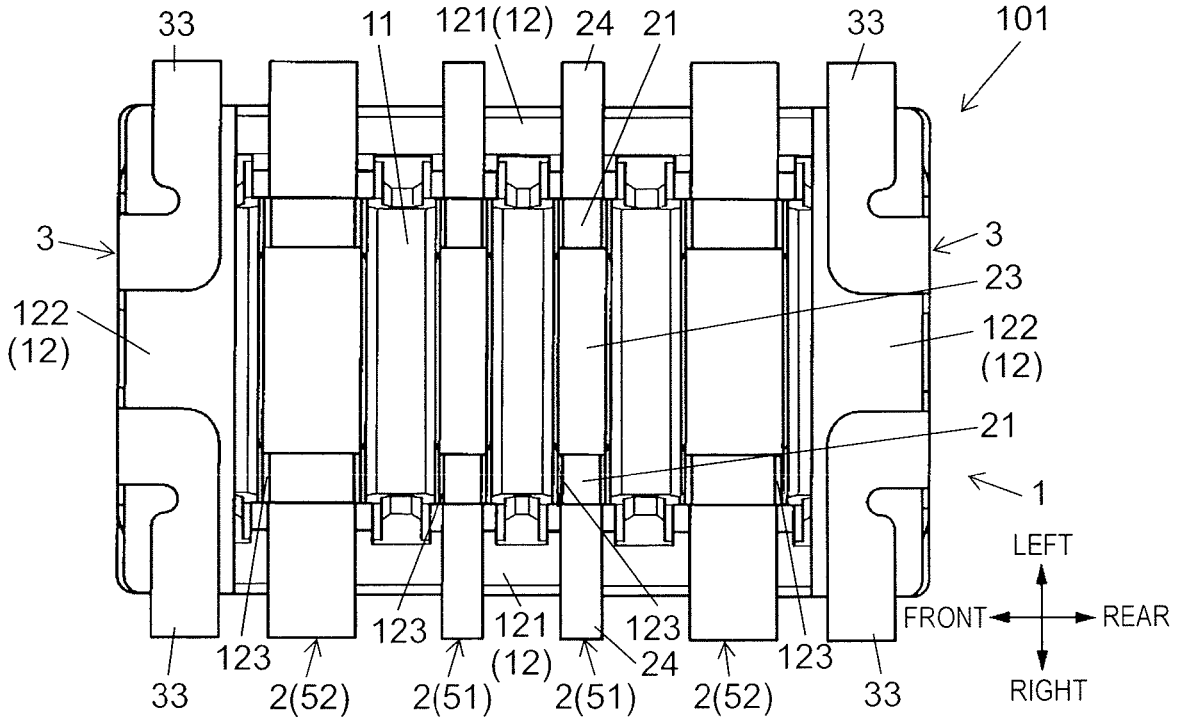
FIG. 12B is a bottom view of the connector according to the second exemplary embodiment.
Figure 13:
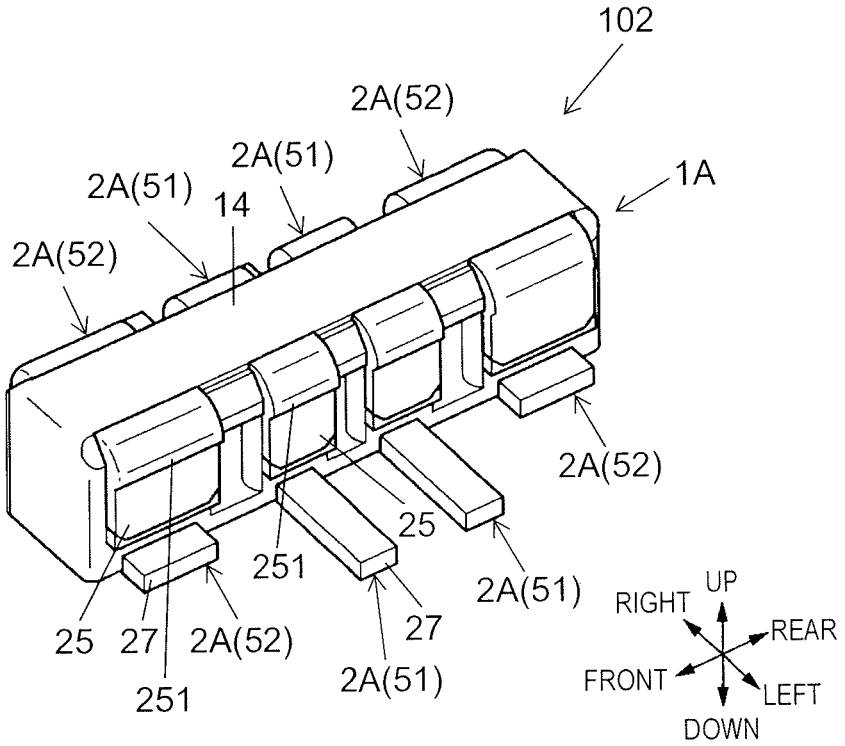
FIG. 13 is a perspective view of another connector according to the second exemplary embodiment.
Figure 14A:
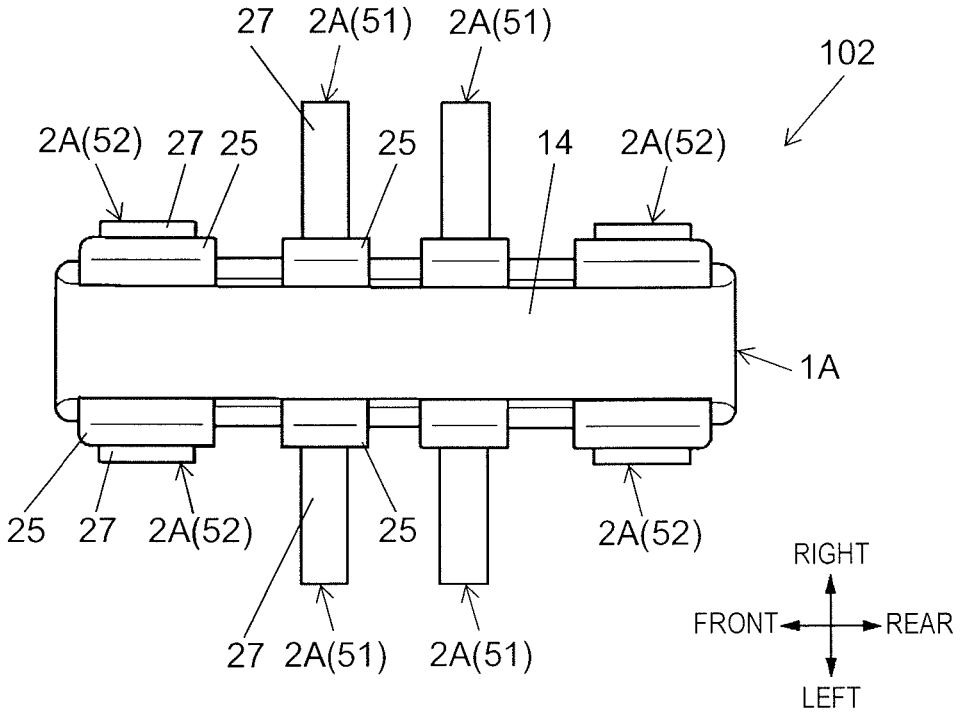
FIG. 14A is a top view of the other connector according to the second exemplary embodiment.
Figure 14B:
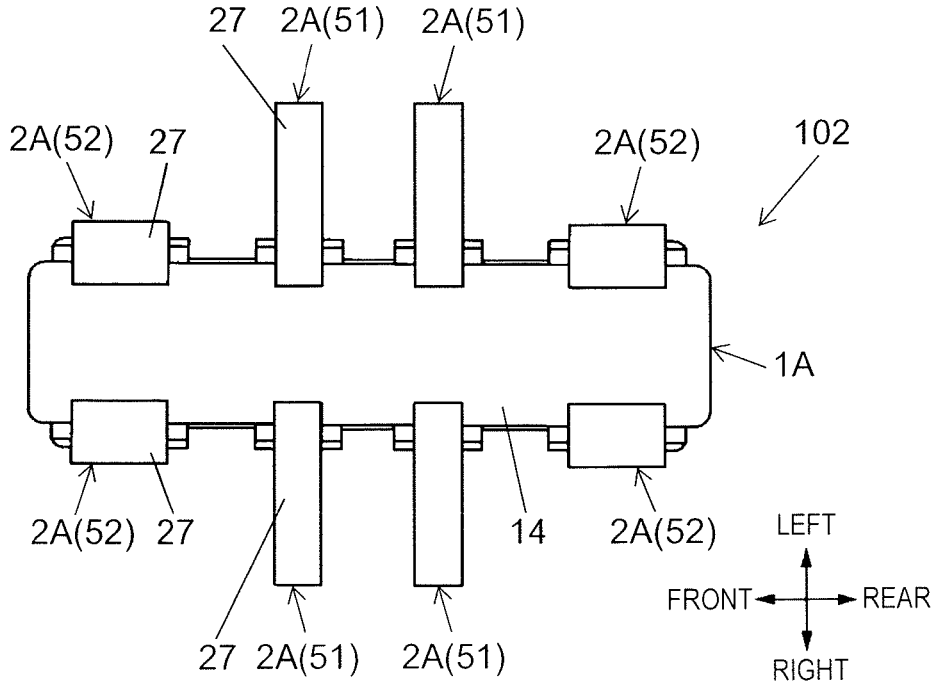
FIG. 14B is a bottom view of the other connector according to the second exemplary embodiment.

As shown in FIGS. 10A and 10B, when connector 101 is connected to other connector 102, a first conductor included in first substrate 41 and a second conductor included in second substrate 42 are electrically connected to each other. Specifically, the plurality of contacts 2 of connector 101 is electrically connected to the pairs of contacts 2A of other connector 102 and thereby connector 101 is connected to other connector 102. In this state, the plurality of (in this example, two) first terminals 51 of connector 101 is electrically connected to the pairs of (in this example, two pairs of) corresponding first terminals 51 of other connector 102, respectively. The plurality of (in this example, two) second terminals 52 of connector 101 is electrically connected to the pairs of (in this example, two pairs of) corresponding second terminals 52 of other connector 102, respectively. In other words, connector 101 and other connector 102 constitute connection device 100. To put it another way, connection device 100 includes connector 101 having contacts 2 and other connector 102 having the pairs of contacts 2A electrically connected to contacts 2. In FIGS. 10A and 10B, other connector 102 inverted longitudinally is illustrated.

As shown in FIG. 10B, when connector 101 is connected to other connector 102, the pair of connecting parts 22 (inner sections 211) are pressed by the pair of contacts 2A along the second direction (the left-right direction). Thus, the pair of connecting parts 22 are elastically deformed along the second direction and put into contact with the pair of contacts 2A. Specifically, inner section 211 and outer section 212 of holder 21 on the first side (the left side) in the second direction are elastically deformed leftward. Similarly, inner section 211 and outer section 212 of holder 21 on the second side (the right side) in the second direction are elastically deformed rightward. Hence, while connector 101 is connected to other connector 102, the pair of connecting parts 22 apply an elastic force to the pair of contacts 2A to return to respective original positions. In other words, contact 2 has a structure such that the holders bend outward to lengthen a distance between the pair of connecting parts 22 when the pair of connecting parts 22 are pressed by the pair of contacts 2A.

A part of first peripheral wall 121 in contact with outer section 212 is pressed by elastically deformed outer section 212 and thus is elastically deformed, albeit slightly. Specifically, this wall is elastically deformed by somewhere between several μm and several tens of μm, while the dimension of housing 1 in the transverse direction (the second direction) is several mm and a dimension of first peripheral wall 121 in the transverse direction (the second direction) is several hundreds of μm.

(3) Advantages

In connector 101 of this exemplary embodiment, contacts 2 each have a pair of connecting parts 22. In connector 101 of this exemplary embodiment, the pair of holders 21 including the pair of connecting parts 22 are held by housing 1. In other words, in connector 101 of this exemplary embodiment, one contact 2 has two electrical contact points that are held by housing 1. Hence, the pair of connecting parts 22 put into contact with contacts 2A of other connector 102 are held by housing 1 while other connector 102 is connected to connector 101. As a result, in connector 101 of this exemplary embodiment, contact 2 provides improved strength while being electrically connected to contacts 2A of other connector 102.

As with connector 101 of this exemplary embodiment, in the connector described in PTL 1 (hereinafter referred to as the "connector of a comparative example"), socket-side terminals (contacts) each have two electrical contact points that come into contact with a header-side terminal (a contact of the other connector). However, in the connector of the comparative example, one of the two contact points of the contact is not held by the housing and is allowed to freely move relative to the housing. Meanwhile, in connector 101 of this exemplary embodiment, the pair of connecting parts 22 of contact 2 are held by housing 1. Thus, connector 101 of this exemplary embodiment enables housing 1 to receive pressure exerted from contacts 2A on the pair of connecting parts 22 while other connector 102 is connected to connector 101.

In other words, connector 101 of this exemplary embodiment has stronger force than the connector of the comparative example in clamping contacts 2A between the pair of connecting parts 22. Hence, connector 101 of this exemplary embodiment is also advantageous in that other connector 102 is hard to be disconnected from connector 101 even if external force is applied to other connector 102 in a direction in which to shift other connector 102 from connector 101.

(4) Modifications

In connector 101 of this exemplary embodiment, a dimension of first peripheral wall 121 in a longitudinal direction (the front-rear direction) is greater than a dimension of second peripheral wall 122 in a longitudinal direction (the front-rear direction). However, the connector may have another configuration. For example, the dimension of first peripheral wall 121 in the longitudinal direction may be smaller than the dimension of second peripheral wall 122 in the longitudinal direction. The dimension of first peripheral wall 121 in the longitudinal direction may be substantially identical to the dimension of second peripheral wall 122 in the longitudinal direction. In these cases, a shape of other connector 102 of this exemplary embodiment is suitably changed in accordance with the shape of connector 101.

In this exemplary embodiment, contact 2 is fixed to substrate 4 with the pair of junctions 24 that each have one surface (the lower surface) joined to substrate 4 by soldering. However, the contact may have another configuration. For example, contact 2 may be fixed to substrate 4 with bottom 23 that has one surface (a lower surface) joined to substrate 4 by soldering, as well as the pair of junctions 24. Contact 2 may be fixed to substrate 4 only with one surface (the lower surface) of bottom 23 joined to substrate 4 by soldering.

In this exemplary embodiment, the pair of contacts 2A aligned along the second direction (the left-right direction) of other connector 102 may be integrated together. This configuration can be achieved if the pair of contacts 2A aligned in the second direction form one metal molding with pendent sections 26 of contacts 2A joined together, for example. In this case, other connector 102 has four contacts 2A aligned along the first direction (the front-rear direction).

In this exemplary embodiment, connector 101 includes two contacts 2 equivalent to first terminals 51 and two contacts 2 equivalent to second terminals 52. This, however, should not be construed to limit a number of contacts 2. For example, connector 101 may include three or more contacts 2 equivalent to first terminals 51, or three or more contacts 2 equivalent to second terminals 52. Connector 101 may include contacts 2 only equivalent to first terminals 51, for example. Moreover, connector 101 may include contacts 2 only equivalent to second terminals 52, for example.

In this exemplary embodiment, contacts 2 are thrust into slits 123 from below and hence are held by housing 1. However, the connector may have another configuration. For example, housing 1 may be an insert mold including contacts 2 as an insert. This configuration dispenses with slits 123.

In this exemplary embodiment, other connector 102 has no metal brackets 3. However, other connector 102 may have metal brackets 3. In this case, metal brackets 3 may be, for example, installed on both ends of main body 14 in a longitudinal direction (the second direction). In this case, a shape of metal bracket 3 may be suitably changed in accordance with the shape of other connector 102.

Second Exemplary Embodiment (1) Detail

With reference to FIGS. 11 to 14B, connector 101, other connector 102, and connection device 100 according to a second exemplary embodiment will now be described in detail. However, the present exemplary embodiment basically shares a configuration with connector 101, other connector 102, and connection device 100 of the first exemplary embodiment, and thus redundant descriptions of shared elements are omitted. In the present exemplary embodiment, connection device 100 is made up of connector 101 of this exemplary embodiment and other connector 102 of this exemplary embodiment.

(1.1) Connector

In this exemplary embodiment, other connector 102 without a pair of flanges 15 as described later is put into recess 13 of connector 101. Thus, a dimension of recess 13 in a longitudinal direction (the first direction) is made smaller because of no occupancy of the pair of flanges 15. In connector 101 of this exemplary embodiment, unlike connector 101 of the first exemplary embodiment, pairs of holders 21 of two contacts 2 equivalent to second terminals 52 are covered with first peripheral walls 121. Further, in connector 101 of this exemplary embodiment, a pair of metal brackets 3 are without projected section 321.

Consequently, housing 1 of connector 101 in this exemplary embodiment is made smaller in dimension along a longitudinal direction (the first direction) than housing 1 of the first exemplary embodiment.

(1.2) Other Connector

In other connector 102 of the present exemplary embodiment, unlike other connector 102 of the first exemplary embodiment, housing 1A includes main body 14 without a pair of flanges 15. As a result, housing 1A of other connector 102 in this exemplary embodiment is made smaller in dimension along a longitudinal direction (the first direction) than housing 1A of the first exemplary embodiment. In other connector 102 of this exemplary embodiment, a dimension of terminal section 27 in the second direction (the left-right direction) is larger for contacts 2A equivalent to first terminals 51 than for contacts 2A equivalent to second terminals 52. In other words, an extent of terminal section 27 protruding from housing 1A is greater for contacts 2A equivalent to first terminals 51 than for contacts 2A equivalent to second terminals 52. Thus, every terminal section 27 of contacts 2A equivalent to first terminals 51 has an increased amount of protrusion from housing 1A and an increased junction area that is joined to substrate 4. This configuration enables contacts 2A to be more firmly fixed to substrate 4.

As described above, connector 101 and other connector 102 of this exemplary embodiment are smaller in dimension along the longitudinal direction (the first direction) than connector 101 and other connector 102 of the first exemplary embodiment, respectively. In other words, connector 101 and other connector 102 of this exemplary embodiment owing to other connector 102 without the pair of flanges 15 are made smaller in size than connector 101 and other connector 102 of the first exemplary embodiment, respectively.

In a similar way to connector 101, other connector 102, and connection device 100 of the first exemplary embodiment, connector 101, other connector 102, and connection device 100 according to the present exemplary embodiment can be suitably combined with any of the modifications of the first exemplary embodiment.

CONCLUSION

As described above, connector 101 according to the present disclosure includes housing 1 and contact 2 held by peripheral wall 12 of housing 1. Housing 1 has recess 13 that other connector 102 is put into and peripheral wall 12 surrounding recess 13. Contact 2 has a pair of holders 21 and a pair of connecting parts 22 included in respective holders 21. The pair of holders 21 face each other through gap 60 (a first space) that is disposed in recess 13. The pair of connecting parts 22 each face gap 60 (the first space). Other connector 102 is designed to be electrically connected to the pair of connecting parts 22.

According to this configuration, the pair of connecting parts 22 put into contact with contact 2A (another contact) of other connector 102 are held by housing 1 while other connector 102 is connected to connector 101. Hence, according to this configuration, contact 2 provides improved strength while being electrically connected to contact 2A (the other contact) of other connector 102.

Preferably, connector 101 according to the present disclosure has the following configuration.

Contact 2 further includes a pair of junctions 24 each extending in a direction along which the pair of holders 21 are aligned. One of junctions 24 is disposed on a first end of contact 2, and the other of junctions 24 is disposed on a second end of contact 2. The pair of junctions 24 are configured to be joined to a substrate.

This configuration ensures that both ends of contact 2 are fixed to substrate 4 and hence the pair of holders 21 are readily and firmly held by housing 1. Thus, according to this configuration, contact 2 provides further improved strength while being electrically connected to contact 2A (the other contact) of other connector 102. This configuration also means that at least two places of contact 2 are joined to substrate 4 and hence enables contact 2 to provide improved heat dissipation. However, this configuration is not essential, and a portion of contact 2 other than the pair of junctions 24 may be joined to substrate 4. For example, bottom 23 of contact 2 may be joined to substrate 4.

More preferably, connector 101 according to the present disclosure has the following configuration.

The pair of connecting parts 22 have a mechanism to lock connection between contact 2 and other connector 102 and break the locked connection in response to application of a predetermined degree or greater of force.

This configuration with the lock mechanism hinders other connector 102 from being disconnected from connector 101. In particular, this configuration owing to the lock mechanism provided for each of the pair of connecting parts 22 makes it more difficult for other connector 102 to be disconnected from connector 101 as compared to a configuration with only one lock mechanism. However, this configuration is not essential, and the pair of connecting parts 22 may have no lock mechanism. Only one of the pair of connecting parts 22 may have a lock mechanism.

More preferably, connector 101 according to the present disclosure has the following configuration.

Contact 2 further includes bottom 23 linking the pair of holders 21. Bottom 23 is disposed in recess 13. The pair of holders 21 each include inner section 211 facing gap 60 (the first space), outer section 212 opposed to inner section 211, and link section 213 linking inner section 211 to outer section 212. Each connecting part 22 is a portion of inner section 211.

According to this configuration, while connector 101 is connected to other connector 102, inner sections 211 acting as connecting parts 22 apply elastic force to contact 2A (the other contact) with which the inner sections are in contact. Thus, this configuration contributes to improved reliability in electrical connection between contact 2 and contact 2A (the other contact). However, this configuration is not essential, and the pair of holders 21 may not include any of inner sections 211, outer sections 212, and link sections 213, for example.

More preferably, connector 101 according to the present disclosure has the following configuration.

Contact 2 is held by peripheral wall 12 through the pair of outer sections 212.

This configuration enables housing 1 to hold connecting parts 22 while elasticity of inner sections 211 acting as connecting parts 22 is maintained. However, this configuration is not essential, and a portion of contact 2 (e.g., bottom 23) other than outer sections 212 may be held by housing 1.

More preferably, connector 101 according to the present disclosure has the following configuration.

Outer sections 212 each have surface 212*a* facing inner section 211 and surface 212*b* opposed to surface 212*a*. Surfaces 212*a* and 212*b* are in contact with peripheral wall 12.

This configuration prevents outer sections 212 from being excessively deformed even if these sections are pressed by contact 2A (the other contact) when other connector 102 is connected to connector 101. However, this configuration is not essential, and surface 212*b* of outer section 212 opposed to surface 212*a* may not be in contact with a part of peripheral wall 12.

More preferably, connector 101 according to the present disclosure has the following configuration.

The pair of holders 21 face each other without any object interposed.

This configuration allows a distance between the pair of holders 21 to be made smaller as compared to an instance where an obstacle (an object) exists in recess 13. Hence, this configuration contributes to a reduction in size of contact 2 and in turn contributes to a reduction in size of housing 1 holding contact 2. However, this configuration is not essential, and the pair of holders 21 may face each other through a part of housing 1, for example, in recess 13.

More preferably, connector 101 according to the present disclosure has the following configuration.

Contact 2 further includes a pair of junctions 24 that are disposed on both ends of contact 2 and configured to be joined to substrate 4, and bottom 23 that is disposed in recess 13 to link the pair of holders 21 together. The pair of junctions 24 are each disposed on an opposite side of one of holders 21 from the other of holders 21. The pair of holders 21 each include inner section 211 facing gap 60 (the first space), outer section 212 opposed to inner section 211, and link section 213 linking inner section 211 to outer section 212. The pair of connecting parts 22 are each a portion of inner section 211.

According to this configuration, while connector 101 is connected to other connector 102, inner sections 211 acting as connecting parts 22 apply elastic force to contact 2A (the other contact) with which the inner sections are in contact. Thus, this configuration contributes to improved reliability in electrical connection between contact 2 and contact 2A.

According to this configuration, in a direction along which the pair of holders 21 are aligned, the pair of junctions 24 are disposed outside the pair of holders 21 and are fixed to substrate 4. Thus, this configuration enables junctions 24 to receive pressure exerted from contact 2A on connecting parts 22 while other connector 102 is connected to connector 101. Hence, this configuration contributes to a further improvement in the reliability of electrical connection between contact 2 and contact 2A (the other contact). However, this configuration is not essential, and the pair of holders 21 may not include any of inner sections 211, outer sections 212, and link sections 213, for example. The pair of junctions 24 may be, for example, disposed inside the pair of holders 21 in the direction along which the pair of holders 21 are aligned.

A header according to the present disclosure is equivalent to other connector 102 connected to any connector 101 described above. The header has housing 1A including main body 14 designed to be put into recess 13, and a pair of contacts 2A (the other contact) that are held by main body 14 so as to be exposed to outside main body 14. The pair of contacts 2A (the other contact) are electrically connected to the pair of connecting parts 22.

This configuration enables the header to be used for connector 101 that has contact 2 capable of providing improved strength while being electrically connected to contacts 2A (the other contact) of other connector 102.

More preferably, the header according to the present disclosure has the following configuration.

A space between the pair of contacts 2A is occupied by main body 14.

This configuration enables main body 14 to receive pressure exerted from connecting parts 22 on contacts 2A (the other contact) while the header (connector 102) is connected to connector 101. Hence, this configuration prevents contacts 2A (the other contact) from being excessively deformed. However, this configuration is not essential, and a gap may exist between the pair of contacts 2A.

More preferably, the header (the other connector) according to the present disclosure has the following configuration.

Housing 1A (another housing) further includes flanges 15 each protruding in a direction intersecting with a direction along which the pair of contacts 2A (the other contact) are aligned. Each flange 15 protrudes beyond areas of the pairs of contacts 2A that come into contact with connecting parts 22 in the direction along which the pair of contacts 2A are aligned.

This configuration hinders housing 1A from being put into connector 101 with other connector 102 shifted relative to connector 101 in the second direction (the left-right direction) when housing 1A (the other housing) is connected to connector 101. Hence, this configuration makes it difficult for contacts 2A (the other contact) to come into contact with any portion of connector 101 other than contact 2 when other connector 102 is connected to connector 101. However, this configuration is not essential, and housing 1A may not include the pair of flanges 15.

Connection device 100 according to the present disclosure includes any connector 101 described above and a pair of contacts 2A (the other contact) electrically connected to contact 2.

Connection device 100 according to this configuration includes contact 2 capable of providing improved strength while being electrically connected to contacts 2A (the other contact) of other connector 102.

Connector 101, other connector 102, and connection device 100 according to each of the first and the second exemplary embodiments have been described. However, the first and the second exemplary embodiments described above are each merely one example of various exemplary embodiments according to the present disclosure. Various modifications may be made to the first and the second exemplary embodiments to suit design or other requirements as long as the object of the present disclosure is fulfilled.

REFERENCE MARKS IN THE DRAWINGS

1: housing
1A: housing (other housing)
2: contact
2A: contact (other contact)
3: metal bracket
4: substrate
11: bottom wall
12: peripheral wall
13: recess
14: main body
15: flange
21: holder
22: connecting part
23: bottom
24: junction
25: contact section
26: pendent section
27: terminal section
31: main section
32: side section
33: bottom section
41, 42: substrate
51, 52: terminal
60: gap (first space)
100: connection device
101: connector
102: other connector (header)
121: first peripheral wall
122: second peripheral wall
211: inner section
212: outer section
213: link section
214: projection (lock mechanism)
251: projection
321: projected section

The invention claimed is:

1. A connector comprising:

a housing having a recess and a peripheral wall surrounding the recess, an another connector being capable of fitting in the recess; and a contact having a first holder and a second holder, the first holder including a first connecting part, the second holder including a second connecting part, the contact being held by the peripheral wall of the housing, wherein the first holder and the second holder face each other through a first space, the first space is disposed in the recess, and the first connecting part and the second connecting part each face the first space, wherein the contact further includes a bottom linking the first holder and the second holder together, the bottom is disposed in the recess, the first holder includes a first inner section facing the first space, a first outer section opposed to the first inner section, and a first link section linking the first inner section to the first outer section, the second holder includes a second inner section facing the first space, a second outer section opposed to the second inner section, and a second link section linking the second inner section to the second outer section, the first connecting part is a portion of the first inner section, and the second connecting part is a portion of the second inner section, wherein the contact is held by the peripheral wall through the first outer section and the second outer section, wherein the first outer section includes a first surface facing the first inner section and a second surface opposed to the first surface, the first surface and the second surface are in contact with the peripheral wall, and wherein the another connector is electrically connected to the first connecting part and the second connecting part.

2. The connector according to claim 1, wherein the contact further includes a first junction and a second junction, the first junction and the second junction each extend in a direction along which the first and the second holders are aligned, the first junction is disposed on a first end of the contact, and the second junction is disposed on a second end of the contact, and the first junction and the second junction are configured to be joined to a substrate.

3. The connector according to claim 1, wherein the first connecting part and the second connecting part have a mechanism to lock an connection between the contact and the another connector and break the connection between the contact and the another connector in response to application of a predetermined degree or greater of force.

4. The connector according to claim 1, wherein the second outer section includes a third surface facing the second inner section and a fourth surface opposed to the third surface, and the third and the fourth surfaces are in contact with the peripheral wall.

5. The connector according to claim 1, wherein the first holder and the second holder face each other without any object interposed.

6. The connector according to claim 1, wherein the contact further includes a first junction disposed on a first end of the contact, the first junction being configured to be joined to a substrate, a second junction disposed on a second end of the contact, the second junction being configured to be joined to the substrate, and a bottom disposed in the recess, the bottom linking the first holder and the second holder together, the first junction is disposed on an opposite side of the first holder from the second holder, the second junction is disposed on an opposite side of the second holder from the first holder.

7. A header equivalent to the another connector connected to the connector according to claim 1, the header comprising:

an another housing including a main body designed to be put into the recess; and a first another contact and a second another contact that are held by the main body so as to be exposed from the main body, the first another contact is electrically connected to the first connecting part, and wherein the second another contact is electrically connected to the second connecting part.

8. The header according to claim 7, wherein a space between the first another contact and the second another contact is occupied by the main body.

9. The header according to claim 7, wherein the other housing further includes a flange protruding in a direction intersecting with a direction along which the first another contact and the second another contact are aligned, and wherein the flange protrudes beyond both an area of the first another contact that comes into contact with the first connecting part and an area of the second another contact that comes into contact with the second connecting part in the direction along which the first another contact and the second another contact are aligned.

10. A connection device comprising:

the connector according to claim 1; and another connector having a first another contact and a second another contact that are electrically connected to the contact.

* * * * *